US007138971B2

(12) United States Patent
Miyazaki

(10) Patent No.: US 7,138,971 B2
(45) Date of Patent: Nov. 21, 2006

(54) POWER SUPPLY CIRCUIT FOR DRIVING LIQUID CRYSTAL DISPLAY

(75) Inventor: Kiyoshi Miyazaki, Tokyo (JP)

(73) Assignee: NEC Electronics Corp., Kanagawa (JP)

( * ) Notice: Subject to any disclaimer, the term of this patent is extended or adjusted under 35 U.S.C. 154(b) by 455 days.

(21) Appl. No.: 10/087,859

(22) Filed: Mar. 5, 2002

(65) Prior Publication Data

US 2002/0154080 A1 Oct. 24, 2002

(30) Foreign Application Priority Data

Mar. 9, 2001 (JP) ..... 2001-066595

(51) Int. Cl.
*G09G 5/00* (2006.01)
*G09G 5/10* (2006.01)
*G09G 3/36* (2006.01)

(52) U.S. Cl. ..... 345/87; 345/89; 345/204; 345/211; 345/212; 345/690

(58) Field of Classification Search ..... 345/211, 345/87

See application file for complete search history.

(56) References Cited

U.S. PATENT DOCUMENTS 5,859,632 A * 1/1999 Ito ..... 345/211
5,929,847 A * 7/1999 Yanagi et al. ..... 345/204
6,084,580 A * 7/2000 Takahashi et al. ..... 345/211

FOREIGN PATENT DOCUMENTS

JP 2695981 B2 9/1997
JP 10-31200 A 2/1998

* cited by examiner

*Primary Examiner*—Sumati Lefkowitz
*Assistant Examiner*—Alexander S. Beck
(74) *Attorney, Agent, or Firm*—Sughrue Mion, PLLC

(57) ABSTRACT

A drive power supply circuit for driving liquid crystal display of the present invention generates necessary levels in an LCD drive power supply circuit that generates drive levels for LCDs in an LCD controller/driver IC by means of switching connection to capacitors in a constant manner or in synchronism with the timing of LCD driving. It allows reduction in number of the components such as amplifiers for level generation and external capacitors, which in turn reduces current consumption of the entire system, chip areas, and mounting areas.

16 Claims, 14 Drawing Sheets

POWER SUPPLY CIRCUIT FOR DRIVING LIQUID CRYSTAL DISPLAY

BACKGROUND OF THE INVENTION

1. Field of the Invention

The present invention relates to a power supply circuit for driving a liquid crystal display (LCD). More particularly, the present invention relates to a power supply circuit used to generate different levels of voltage required to drive an LCD.

2. Description of the Prior Art

Portable electronic devices including cellular phones have become ubiquitous in recent years. Such portable electronic devices comprise an LCD panel as their display screen. The LCD panel is driven by a certain kind of power supply circuit which is well known in the art. More specifically, a multi-level power supply circuit is necessary to drive LCD panels which generates different levels of voltage The power supply circuit used for this purpose is hereinafter referred to as an "LCD drive power supply circuit". It is noted that the term "LCD panel" as used herein is not limited to a particular LCD panel. Instead, it includes any kinds of similar LCDs which are used in portable electronic devices.

The multi-level LCD drive power supply circuit is incorporated within LCD drivers or LCD controller/driver ICs to generate necessary levels of voltage. Some conventional multi-level LCD drive power supply circuits use a separate power supply IC and resistors. However, the demand for lower power consumption and smaller driving circuit has been increasing as the LCD panels have found more and more applications in the portable electronic devices. A solution to meet such demand is to use a single chip LCD controller/driver on which an LCD drive power supply circuit is also incorporated.

A conventional single-chip LCD controller/driver with an on-chip LCD drive power supply circuit comprises a resistive voltage divider. The resistive voltage divider provides scaling of the peak voltage for LCD driving on desired voltage levels. However, charging and discharging the capacitive load of the panel would result in rounding of the waveform even when the voltage levels generated by the resistance division are used directly. Thus, the outputs of the resistive voltage divider are supplied to amplifiers where they are converted to have a low impedance. The low impedance waveforms are then supplied to multiplexers (drivers) where a certain level is selected in accordance with frame and display signals. The outputs of the multiplexer are used to drive segment electrodes and common electrodes configuring the panel.

In practice, the panel incorporates a plurality of electrodes and a plurality of corresponding outputs. For example, the panel may be configured of n number of segment electrodes and m number of common electrodes, which provides a display panel of n by m pixels. As is well known in the art, the common electrode is also referred to as a scanning electrode. Only one common electrode generates an output at the selected voltage level (selective output). The outputs from the remaining common electrodes are at the non-selected voltage levels. The segment electrodes generate outputs at the selected and unselected levels in synchronism with the selective output supplied from the common electrode. The outputs from the segment electrodes control the ON/OFF of the corresponding pixel because each cross point of the segment and common electrodes is a display pixel. It is noted that the voltage applied to the LCD is similar to the alternating current. Accordingly, the level selective/unselective modes for LCD driving fluctuate periodically according to a time period called a "frame".

The voltage levels V1 to V5 for LCD driving are typically connected to capacitors C0 to C4 in order to stabilize the levels. The amplifiers A1 to A4 used to provide the levels for LCD driving are designed to reduce idling current and prevent shoot-through current as much as possible due to the capacitive load of the panel. Instantaneous switching of the load may result in fluctuation of the levels for a time period determined by the through rate of the amplifiers. This may adversely affect the display itself. With respect to the above, an external capacitor (bypass capacitor) may be added to each amplifier in order to eliminate any fluctuation of the levels if the through rate of the amplifier is not enough.

On the other hand, there have been increasing demands for lower power consumption and size reduction in the portable electronics field. In particular, it is required to eliminate any external capacitor and reduce the size of a chip as much as possible, in addition to reducing current consumption of a power supply circuit.

Japanese Patent Laid-Open No. 10-31200 discloses an LCD drive power supply circuit that meets the above-mentioned demands for lower power consumption, in which intermediate levels are used as the power supplies for level amplifiers with potential levels V3 and V4. Alternatively, Japanese Patent No. 2695981 (corresponding to EP0 479 304 B1) discloses an LCD drive power supply circuit having a configuration where the bias on an amplifier is turned OFF temporarily.

The LCD drive power supply circuits disclosed in the above specifications require lowerpower consumption. However, the chip size is increased due to the additional circuits. In addition, none of the above LCD drive power supply circuits are directed to the reduction of the circuit scale reduction.

Therefore, an object of the present invention is to provide an LCD drive power supply circuit with which the scale of the circuit can be reduced with a smaller number of components and in which switches and control signals are used to achieve a lower power consumption.

SUMMARY OF THE INVENTION

In order to achieve the above-mentioned objects, the present invention provides a power supply circuit for driving liquid crystal display adapted to generate two or more drive voltages having intermediate voltage levels with respect to a peak voltage level, the intermediate voltage levels being classified into a first group of levels and a second group of levels, the power supply circuit for driving liquid crystal display comprising an amplifier having a voltage follower configuration; one or more capacitors connected to the amplifier, the capacitors and the amplifier being provided for each level of the first group of levels to generate a level in cooperation with each other for the first group of levels; and switching means controlled at a predetermined timing to select a predetermined one of the capacitors to generate a level with a discharge voltage of the capacitor and the peak voltage level for the second group of levels.

In the present invention, all levels may be generated with n number or less of the amplifier and n number or less of the capacitors when the number of the levels is equal to 2n for the intermediate voltage levels, wherein n is an integer. Alternatively, all levels may be generated with n number or less of the amplifier and 3n number or less of the capacitors when the number of the levels is equal to 4n for the intermediate voltage levels, wherein n is an integer.

In addition, the present invention provides a power supply circuit for driving liquid crystal display adapted to generate four drive voltages having intermediate voltage levels with respect to a peak voltage level, the power supply circuit for driving liquid crystal display comprising two amplifiers each having a voltage follower configuration, two capacitors, and two switching means, the four intermediate voltage levels being classified into a first group of levels and a second group of levels, wherein the amplifiers and the capacitors generate a level for the two levels of the first group of levels, and the switching means controlled at a predetermined timing selects a predetermined one of the capacitors to generate a level with a discharge voltage of the capacitor and the peak voltage level for the two levels of the second group of levels.

The present invention also provides a power supply circuit for driving liquid crystal display adapted to generate four drive voltage shaving intermediate voltage levels with respect to a peak voltage level, the power supply circuit comprising one amplifier having a voltage follower configuration, three capacitors, and three or four switching means, the four intermediate voltage levels being classified into a first group of levels and a second group of levels, wherein the amplifiers and the capacitors generate a level for the one level of the first group of levels, and the switching means controlled at a predetermined timing selects a predetermined one of the capacitors to generate a level with a discharge voltage of the capacitor and the peak voltage level for the remaining three levels of the second group of levels.

Furthermore, the power supply circuit for driving liquid crystal display may further comprise a segment electrode and an additional capacitor which is used to stabilize the levels forming the second group of levels to a certain level available for being supplied to the segment electrode.

It is preferable that the capacitor or capacitors used to generate have a function to stabilize the level, for the levels for the second group of levels.

In the present invention, the timing is determined so as to be in synchronism with a display signal for a liquid crystal display and selection of the capacitor(s) is performed by the switching means at a timing that does not affect the liquid crystal display. The display signal preferably comprises either one of a frame signal, a data output signal, and a signal generated on the basis of the data output signal.

In the present invention, it is preferable that the timing is connected to the capacitor(s) to generate a level only during a certain period of switching the outputs and the timing is connected to a predetermined level to charge the capacitor(s) during the remaining period of time.

In the present invention, the first group of levels may be configured with the levels on a low potential side and the amplifier(s) and the capacitor(s) may have a low withstanding voltage.

BRIEF DESCRIPTION OF THE DRAWINGS

These objects as well as other objects, features and advantages of the present invention will become apparent to those skilled in the art from the following description with reference to the accompanying drawings in which.

DETAILED DESCRIPTION OF THE PREFERRED EMBODIMENTS

A conventional LCD drive power supply circuit is described first with reference to the drawings, for the purpose of facilitating the understanding of the present invention.

Figure 2:
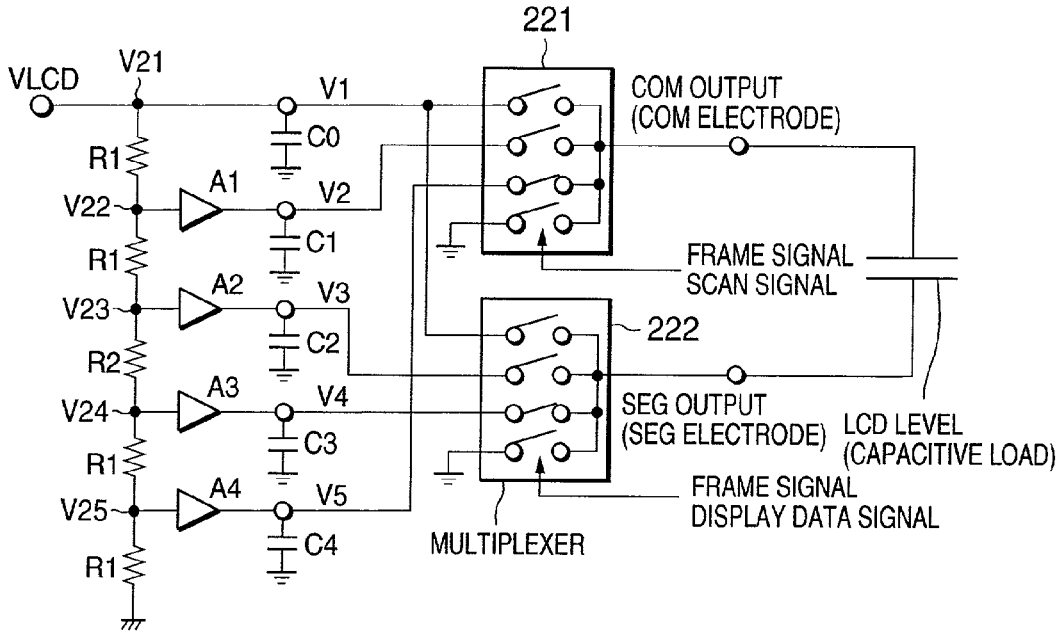
Fig.2 PRIOR ART
FIG. 2 is a circuit diagram showing a configuration of an LCD drive power supply circuit according to the first prior art.

Referring to FIG. 2, a conventional LCD drive power supply circuit comprises a resistive voltage divider. The resistive voltage divider provides scaling of the peak voltage VLCD on voltage levels V1 to V5. The output levels V2 to V5 are supplied to amplifiers A1 to A4 where they are converted to have a low impedance. The low impedance waveforms are then supplied to multiplexers (drivers) 221 and 222 where a certain level is selected in accordance with frame and display signals. The outputs of the multiplexer are used to drive segment (SEG) electrodes and common (COM) electrodes configuring the panel.

The voltage levels V1 to V5 for LCD driving are typically connected to capacitors C1 to C4 in order to stabilize the levels. The amplifiers A1 to A4 used to provide the levels for LCD driving are designed to reduce idling current and prevent shoot-through current as much as possible due to the capacitive load of the panel. Thus, instantaneous switching of the load may result in fluctuation of the levels for a time period determined by the through rate of the amplifiers A1 to A4. This may adversely affect the display itself. With respect to the above, an external capacitor (bypass capacitor)

may be added to each amplifier in order to eliminate any fluctuation of the levels if the through rate of the amplifier is not enough.

On the other hand, there have been increasing demands for lower power consumption and size reduction in the portable electronics field. In particular, it is required to eliminate any external capacitor and reduce the size of a chip as much as possible, in addition to reducing current consumption of a power supply circuit.

Figure 3:
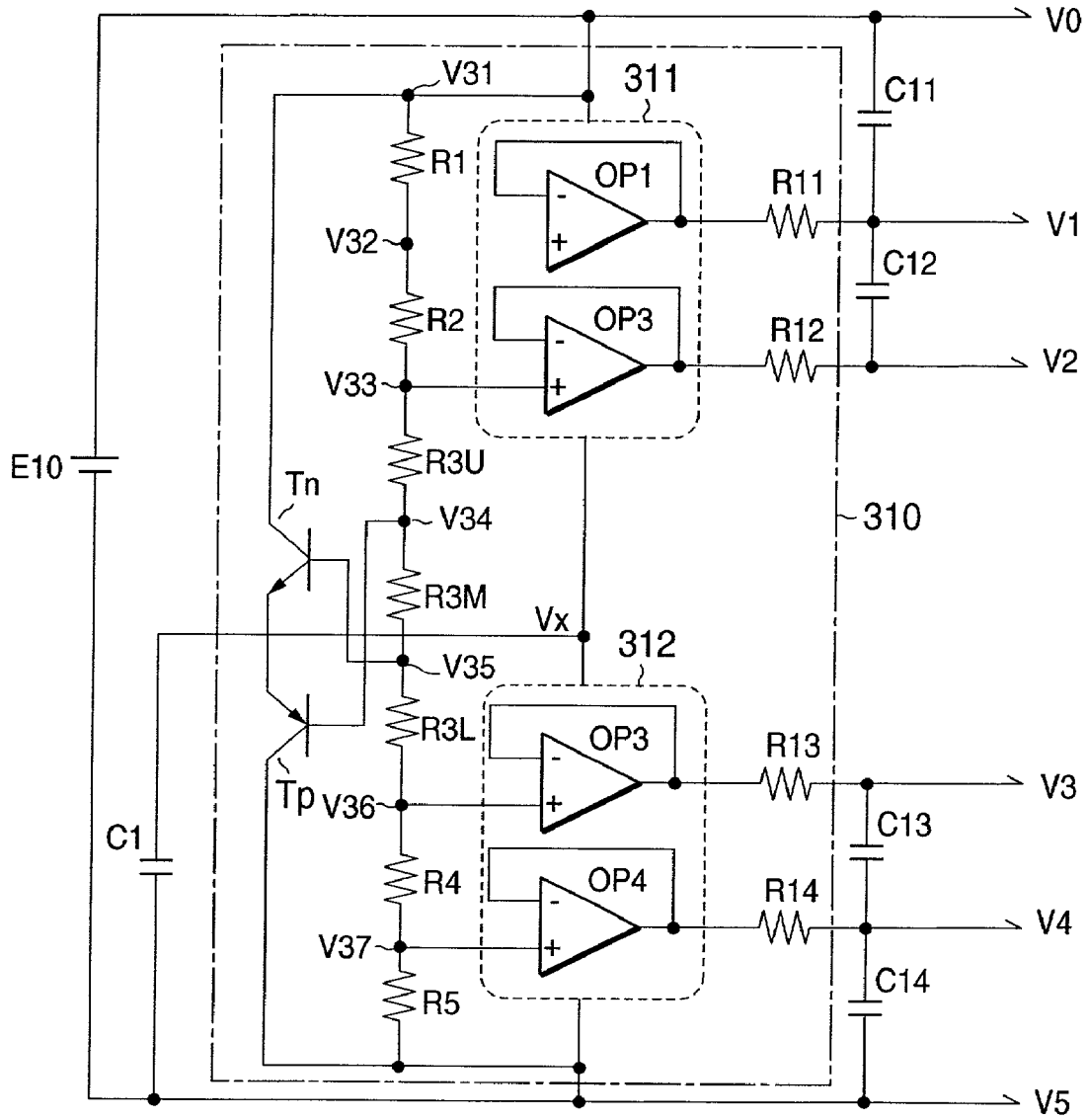
Fig.3 PRIOR ART
FIG. 3 is a circuit diagram showing a configuration of an LCD drive power supply circuit according to a second prior art.
Figure 4:
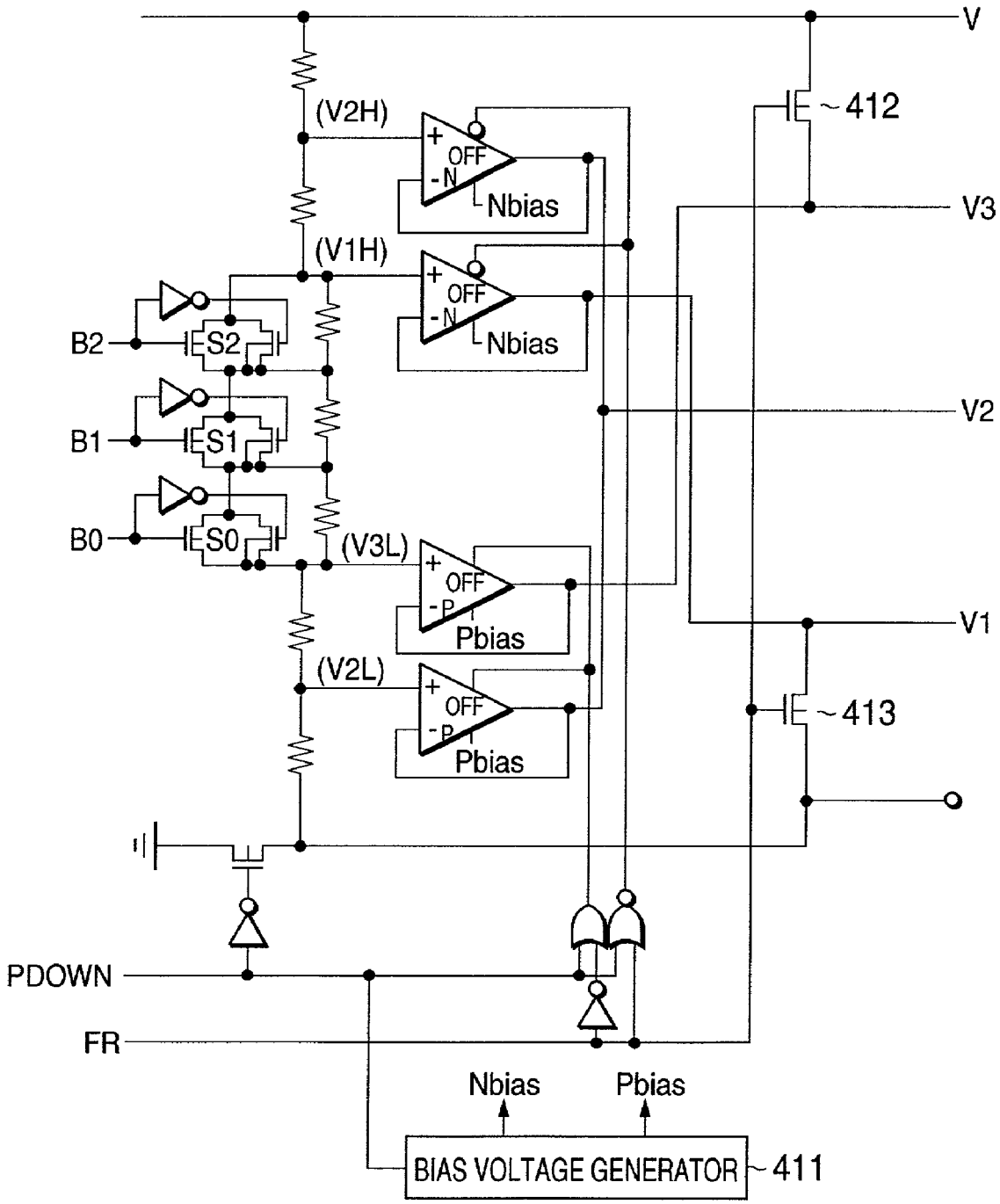
Fig.4 PRIOR ART
FIG. 4 is a circuit diagram showing a configuration of an LCD drive power supply circuit according to a third prior art.

In order to meet the above-mentioned demands for lower power consumption, Japanese Patent Laid-Open No. 10-31200 provides an LCD drive power supply circuit as shown in FIG. 3. In this power supply circuit, intermediate levels are used as the power supplies for level amplifiers OP3 and OP4 with potential levels V3 and V4. Alternatively, Japanese Patent No. 2695981 (corresponding to EP 0 479 304 B1) discloses an LCD drive power supply circuit as shown in FIG. 4. As shown in FIG. 4, this LCD drive power supply circuit comprises a bias voltage generator 411. The bias voltage generator 411 generates an N-bias voltage and a P-bias voltage. As is described above, the voltage applied to the LCD is similar to an alternating current because of a frame signal FR. When the frame signal FR represents a logic "1", first and second amplifiers connected to V2H and V1H, respectively, are in an inactive state. On the other hand, third and fourth amplifiers connected to V3L and V2L, respectively, are in an active state. A P-channel transistor 412 is turned off and an N-channel transistor 413 is turned on. Therefore, the outputs V1, V2, and V3 have zero, V2L, and V3L levels, respectively.

These conventional LCD drive power supply circuits shown in FIGS. 2 to 4 allows reduction of power consumption. However, none of the above LCD drive power supply circuits are directed to the reduction of the circuit scale reduction.

Next, an LCD drive power supply circuit according to embodiments of the present invention is described with reference to the drawings. The embodied LCD drive power supply circuit generates drive levels for LCDs in an LCD controller/driver IC. More specifically, the LCD drive power supply circuit switches connection to capacitors in a constant manner or in synchronism with the timing of LCD driving to generate necessary levels. The LCD drive power supply circuit of the type described allows reduction in number of the components such as amplifiers for level generation and external capacitors, which in turn reduces current consumption of the entire system, chip areas, and mounting areas. This is described below with reference to the drawings.

Figure 5:
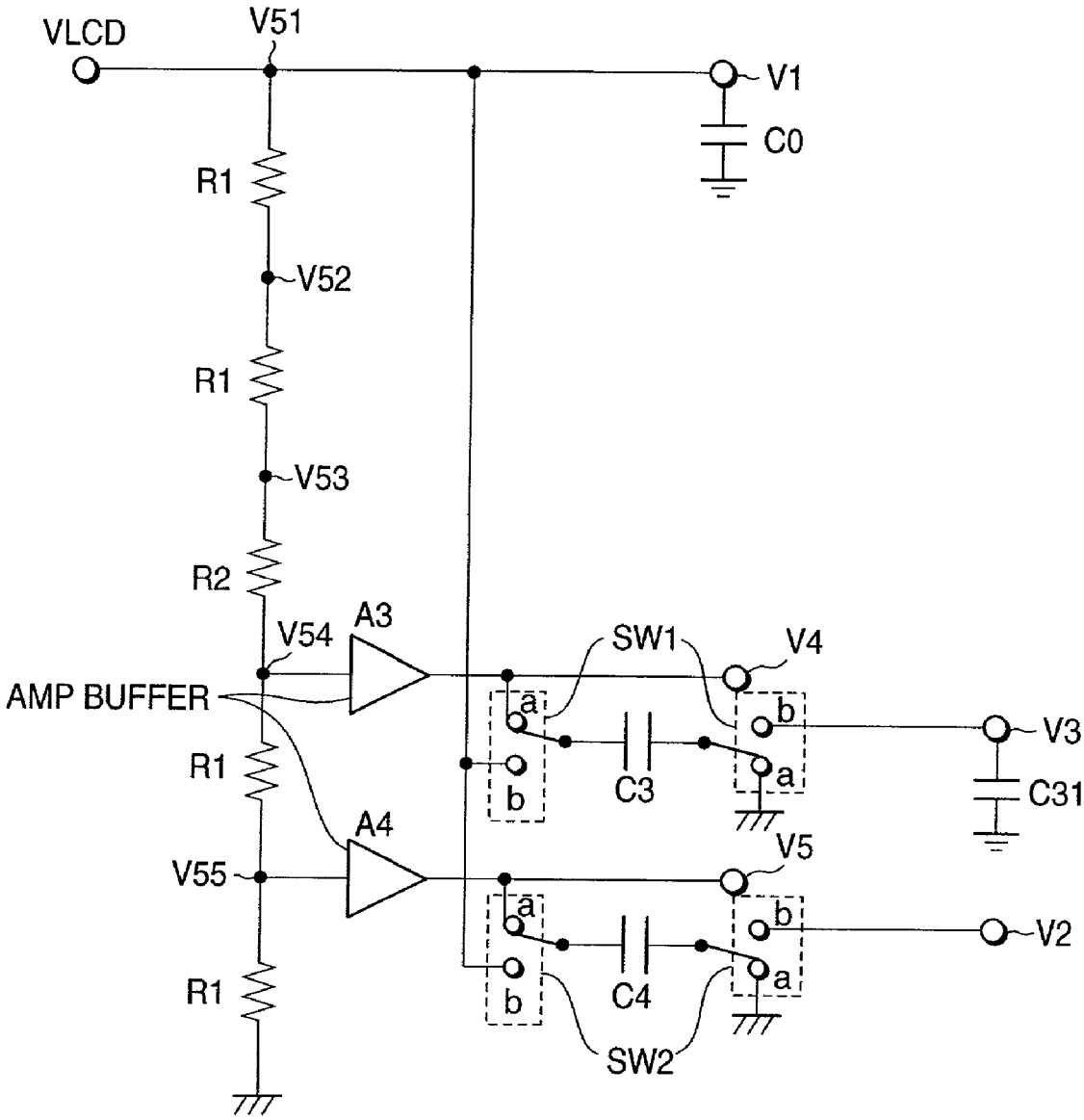
FIG. 5 is a circuit diagram showing a configuration of an LCD drive power supply circuit according to a first embodiment of the present invention.

FIG. 5 is a circuit diagram showing a configuration of the LCD drive power supply circuit according to a first embodiment of the present invention. The power supply circuit in FIG. 5 is characterized in that upper levels (V2, V3) are generated through capacitors (C3, C4) connected to lower levels (V4, V5), rather than being directly generated through amplifiers, in contrast to the conventional power supply circuit where the levels (V2 to V5) for LCD driving are all generated through the amplifiers.

More specifically, the LCD drive power supply circuit switches the capacitors in synchronism with the timing of driving the LCD by using the fact that more than three levels for LCD driving are never selected simultaneously except for the peak and ground potentials VLCD and GND, respectively and that an intermediate potential for LCD driving, i.e., (VLCD −GND)/2 has a symmetric feature. For the potential level V2 level, it is possible to generate a level corresponding to the potential level V2 level by using the potential level V1 level and the bypass capacitor (C4) charged through an amplifier (A4) that generates the potential level V5. For the potential level V3 level, it is possible to generate a level corresponding to the potential level V3 level by using the potential level V1 level and the bypass capacitor (C3) connected to an amplifier (A3) that generates the potential level V4.

With the above-mentioned configuration, it is possible to reduce the number of the amplifiers from four to two. In addition, the capacitor (C4) for the potential level V5 can also be used as the capacitor required for the potential level V2 level, reducing the number of the capacitors. In addition, the capacitor (C3) for the potential level V4 level can also be used as the capacitor for the potential level V3 level by means of selecting the timing of the capacitor switching, as will be described more in detail below.

An additional bypass capacitor, which is required conventionally, can be eliminated because the upper levels are generated by the capacitors (C3, C4). The number of the capacitors (bypass capacitors) can be required as compared with the prior art. In addition, it is possible to reduce the withstanding voltage to half the conventional one. The capacitors and amplifiers configuring the circuit may be reduced in size.

As apparent from the above, according to the present invention, the capacitors (bypass capacitors) used to stabilize the levels are changed by using switches. Thus, the required number of the amplifiers is less than half that of the conventional amplifiers that are equal in number to the output levels. The number of components such as capacitors is reduced by 20% to 50%. As a result, the resultant circuit has a smaller bias current that flows through the amplifiers. This makes it possible to reduce the area required for a semiconductor chip on the circuit.

In addition, the capacitors and amplifiers require lower levels of voltage. Consequently, it becomes possible to use a process, components, and parts of a lower withstanding voltage, as compared with the conventional process, components, and parts that require a higher withstanding voltage. The sizes of the parts and a resulting chip can be reduced, which in turn reduces the consumption current of the circuit.

The embodiment as mentioned above is described more in detail below with reference to the drawings.

[Embodiment 1]

Figure 6:
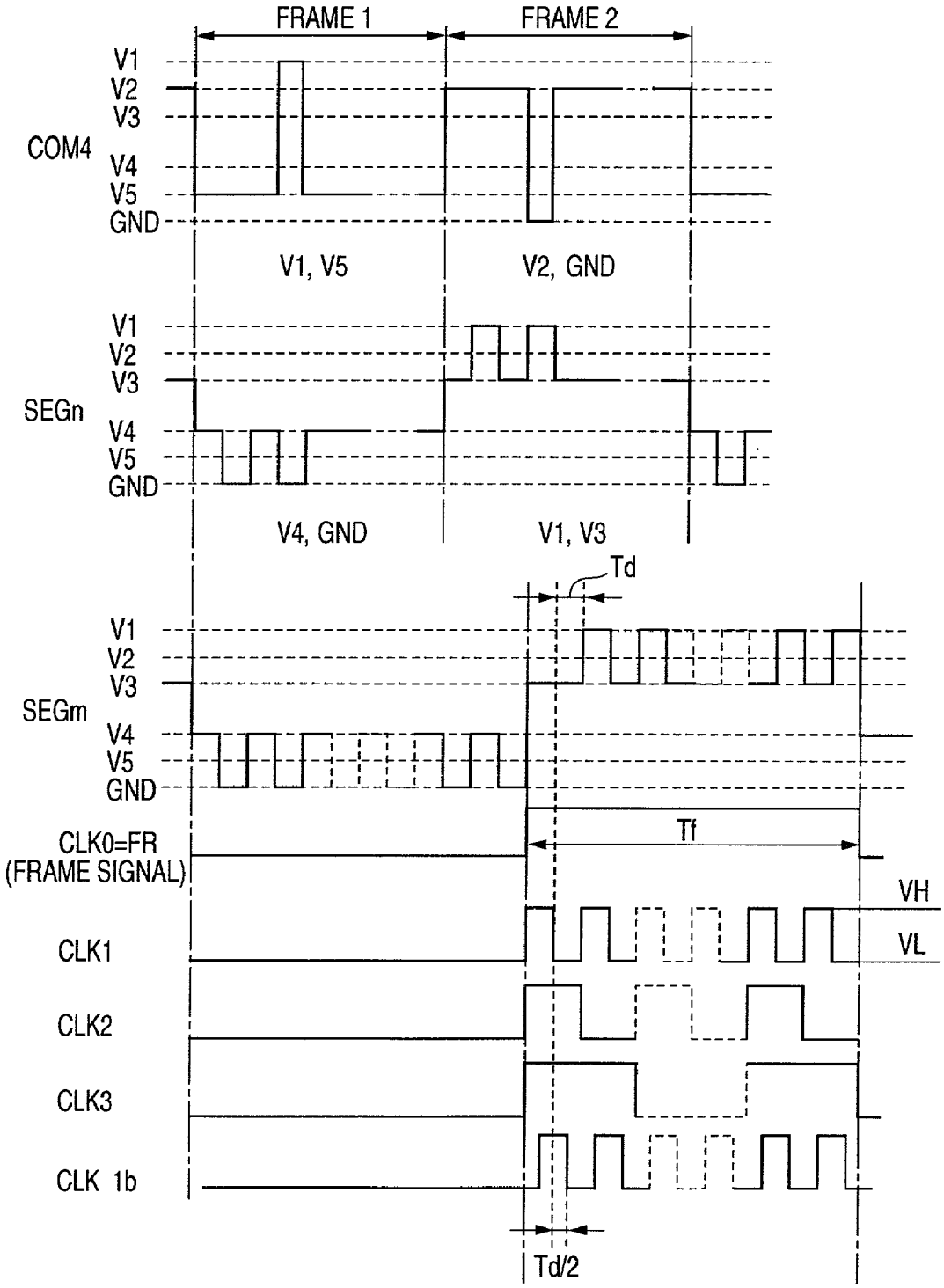
FIG. 6 is a timing chart showing driving waveforms obtained according to the first embodiment of the present invention.

An LCD drive power supply circuit according to the first embodiment of the present invention is described with reference to FIGS. 5 and 6. FIG. 5 is a circuit diagram showing a configuration of the LCD drive power supply circuit according to the first embodiment of the present invention. FIG. 6 is a timing chart showing driving waveforms of COM and SEG.

Referring to FIG. 5, an LCD drive power supply circuit according to this embodiment comprises a resistive voltage divider. The resistive voltage divider is formed of a series of resistors R1 and R2 connected to a high voltage source and a ground. The resistive voltage divider divides down the peak potential VLCD (equal to V1) and the ground potential GND to generate four levels that are necessary for driving the LCD. In general, the following relation holds between the levels:

$$V1-V2=V2-V3=V4-V5=V5-GND(=V0)$$

in order to ensure a DC zero level when the voltages applied by the COM and SEG electrodes (i.e., voltages across the COM and SEG electrodes) are driven in an alternating manner. Output levels from the divider would be determined by the ratio of the resistors R1 and R2.

Of the four levels generated by the resistance division, the lower two levels are applied to amplifiers A3 and A4. The amplifiers A3 and A4 are connected to capacitors C3 and C4. The combination of the amplifiers and capacitors generates the two optimum lower levels V4 and V5 for LCD driving. The upper intermediate level V2 is connected between the lower level V5 and the ground level GND. Likewise, the upper intermediate level V3 is connected between the lower level V4 and the ground level GND. The intermediate levels are generated by means of switching connections to the capacitors C3 and C4 by using switches SW1 and SW2. The capacitors C3 and C4 are charged with charge corresponding to the respective level.

During the period when the lower two levels V4 and V5 are generated or when these levels can be generated, the switch SW1 connects the capacitor C3 between the output of the amplifier A3 and the ground GND while the switch SW2 connects the capacitor C4 between the output of the amplifier A4 and the ground GND. The switches SW1 and SW2 thus stabilize the potential levels V4 and V5 to charge the capacitors with a predetermined level.

On the other hand, the terminals of the capacitors C3 and C4 that are connected to the respective amplifier outputs are connected to the voltage level V1 (i.e., the peak potential VLCD) during the period when the higher two levels V2 and V3 are generated or when these level scan be generated. The other terminal of the capacitor has a level obtained by the following equations:

$$\begin{aligned} &V1 - (\text{inter-terminal voltage of the } C3 \text{ capacitor}) \\ &= V1 - (V4 - GND) \\ &= V1 - (V4 - V5 + V5 - GND) \\ &= V1 - 2 \times V0, \end{aligned} \tag{1}$$

$$\begin{aligned} &V1 - (\text{inter-terminal voltage of the } C4 \text{ capacitor}) \\ &= V1 - (V5 - GND) \\ &= V1 - V0. \end{aligned} \tag{2}$$

There is no problem about the potential levels V2 and V5 that are used for the COM outputs. On the contrary, the potential level V3 applied to a data display electrode (SEG) may badly affect the display when the external capacitors C3 and C4 do not have a capacity that is significantly larger than a load capacity of the panel, due to a level shifting caused by the discharge of the capacitors as a result of load driving of the panel. With this respect, a leveling capacitor C31 is added to open and close the switches in a given cycle. It becomes possible to charge the levels constantly by the capacitors and the potential level V3 level can be kept even when the load capacity is large.

As apparent from the above, the different four levels can be generated at the timing necessary for LCD driving, by using the combination of two amplifiers A3, A4, and three capacitors C3, C4, C31. Though the switch may have a typical configuration, it is preferable that a leak current is as small as possible and that no voltage drop occurs at the switching section because the voltages are generated through the connection between the switch and the capacitor. However, the switch is not specifically limited thereto. Any of the conventional switch may be used that has the above-mentioned features. The capacitor may also be any of the conventional capacitors. Typically, it is preferable to use a capacitor of 0.01 μF to 1 μF that is several ten times larger than the capacity of the panel in order to reduce fluctuation which otherwise would be caused due to the load of the panel.

Next, operation of the LCD drive power supply unit according to this embodiment is described with reference to the timing chart in FIG. 6. In FIG. 6, COMm and SEGn are examples of a panel driving waveform (an output waveform of the driver). As will be described in conjunction with FIG. 11, the COM and SEG outputs are used to turn on and off a liquid crystal cell located at the cross point between the COM and SEG electrodes by means of outputting a level generated by the LCD drive power supply. From the power supply side, the panel load is charged and discharged depending on the change in SEG and COM waveforms.

A clock CLK0 in FIG. 6 is a signal generated at the same timing as a frame signal. The switch SW2 is controlled in accordance with the clock CLK0. It is noted that the following description is made on the assumption that each switch SW is connected to a side A at the low (L) level and to a side B at the high (H) level. As shown in the COM waveform in FIG. 6, the potential level V2 level is never overlapped with the potential level V5 level in a given frame. The potential level V2 level causes less charge and discharge in a given frame (i.e., each COM is scanned only once). Therefore, it is possible to apply a predetermined voltage (V1−V2=V5−GND) to the potential level V2 by means of switching the connection of the capacitor from between V5 and the ground GND to between the potential level V1 and the potential level V2 at the timing of the clock CLK0 (=frame signal).

This voltage is increased as the charge of the capacitor C4 is reduced to approach the potential level V1. When the capacitor C4 has a sufficient capacity of about 0.01 μF to 1 μF to serve as a bypass capacitor having the potential level V5 level. This load capacity is well larger than the load capacity of a typical panel. Therefore, the potential level V2 level causes less charge and discharge with a smaller amount of fluctuation.

On the other hand, the switch SW1 may be controlled with a clock CLK1 and other clocks (e.g., CLK2 and CLK3) obtained by means of dividing the clock CLK1 and a clock CLK1*b* (obtained by phase shifting of the clock CLK1). Upon operation, they are used at a frequency several times higher than that of the clock CLK0. The potential level V3 level is generated with the SEG waveform. The SEG generates the selective and unselective levels depending on whether display is made or not. Therefore, a charged and discharged current during the load driving at the potential level V3 level is larger than COM.

In general, when a panel load of several thousand pF is charged and discharged, and when the capacitor C3 is small (from about ten times larger than the panel to 0.01 μF), the current to be charged and discharged ten times by the panel becomes a current driving capacity (I=f×C×V) that is approximately equal to a single charging and discharging amount by the capacitor C3.

More specifically, in a panel having about 20 display lines, it is not possible to maintain a level with this bypass capacitor when the panel is in a worst pattern (alternating display of selection and unselection). Therefore, unlike the level potential level V2 of the COM, a frequency signal that is several times higher than the frame signal is provided as shown in CLK1 to CLK3 to charge, with the potential level V3 level, the capacitor (bypass capacitor C31) connected to the potential level V3 level and thus stabilize the level.

As described first, during the frame where neither the switch SW1 nor the switch SW2 generates the potential level V2 and the potential level V3 level, a capacitor should be connected between the ground GND and the potential levels V4 and V5 to reduce wasted operational current due to switching operation and stabilize the potential level V4 and V5 levels.

As the control signal for the switch SW1, CLK1 can be used without any trouble. However, it requires the largest operational current because of a high operational frequency (switching frequency). In practice, when the capacitor is large with respect to the panel, the output level does not become low because of charge transfer in the capacitor C3 for several line display data outputs. Accordingly, the power consumption of the entire circuit as well as noises can be reduced by means of optimizing with the switching frequency lowered with the clocks CLK2 and CLK3.

As an indication, a control clock (CLKn) that meets the following equation 3 may be used because the current capacity I=f×C×V.

$$\text{(Load current of the panel)}=\text{(single line scanning frequency)}\times\text{panel load capacity}\times(V1-V3)<\text{(current capacity obtained by } C3)=\text{(frequency of CLKN)}\times\text{capacity of } C3\times\Delta V \quad (3),$$

wherein ΔV is an acceptable level fluctuation (ripple voltage).

As described above, according to the LCD drive power supply circuit of the present embodiment, the optimum levels are generated by using the amplifiers and the capacitors for the lower levels required for the LCD driving, while they are generated using the charge held in the above-mentioned capacitor by means of opening and closing the switches for the upper levels. Thus, it is possible to reduce the number of the amplifiers by half the number of the necessary levels. In addition, the capacitors maybe shared with different levels. This reduces the bias current that flows across the amplifiers in the entire circuit and, in turn, reduces the area of the semiconductor chip used for the circuit.

[Embodiment 2]

Figure 7:
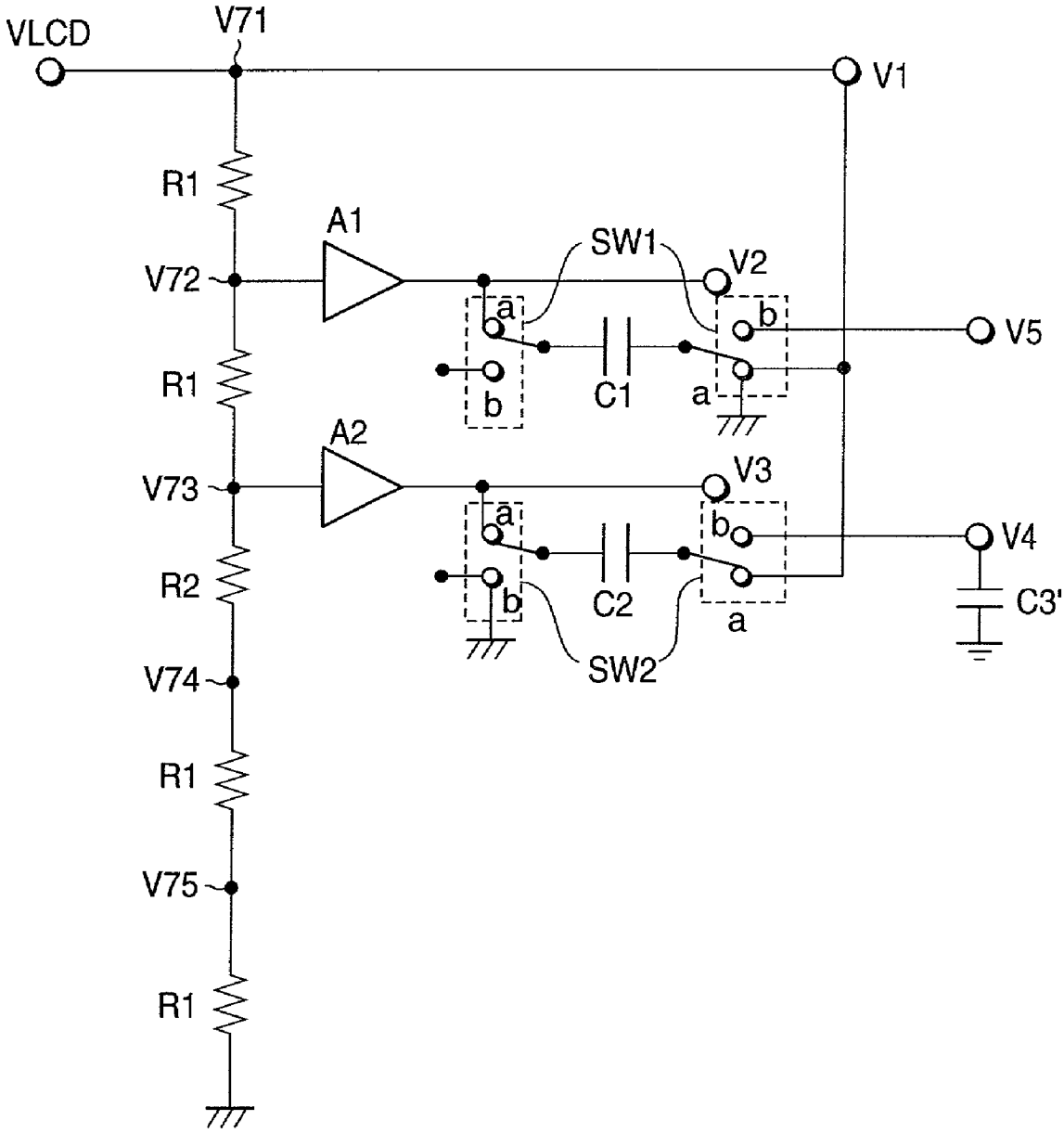
FIG. 7 is a circuit diagram showing a configuration of an LCD drive power supply circuit according to a second embodiment of the present invention.

Next, an LCD drive power supply circuit according to a second embodiment of the present invention is described with reference to FIG. 7. FIG. 7 is a circuit diagram showing a configuration of the LCD drive power supply circuit according to the second embodiment of the present invention. The levels on the high potential side are generated by using the amplifiers A3 and A4 with the levels on the ground potential (GND) side in the first embodiment. On the contrary, the second embodiment is characterized in that the levels on the low potential side are generated by using amplifiers A1 and A2 with the levels on the peak potential (VLCD) side. Other configurations of the LCD drive power supply circuit according to the second embodiment are similar to those of the power supply circuit described in conjunction with the first embodiment.

In general, the ground GND is used as a reference for a sub-potential of a wafer in ICs where a P sub wafer is used as a semiconductor substrate. Therefore, the first embodiment can contributes to reduce the withstanding voltage of the transistors configuring the amplifiers. On the other hand, the transistors are provided with the high voltage side used as a reference in ICs where an N sub wafer is used. Therefore, the withstanding voltage can be reduced with the levels on the peak potential side used as a reference.

With this respect, the configuration of the second embodiment is much more advantageous depending on a reference power supply of a circuit system used. In this event, the output of the amplifier and the capacitor in the second embodiment are switched in a different frame from those in the first embodiment. Thus, a wave form maybe the one obtained by means of shifting the control signal in the first embodiment by a half of a frame period (Tf).

[Embodiment 3]

Figure 8:
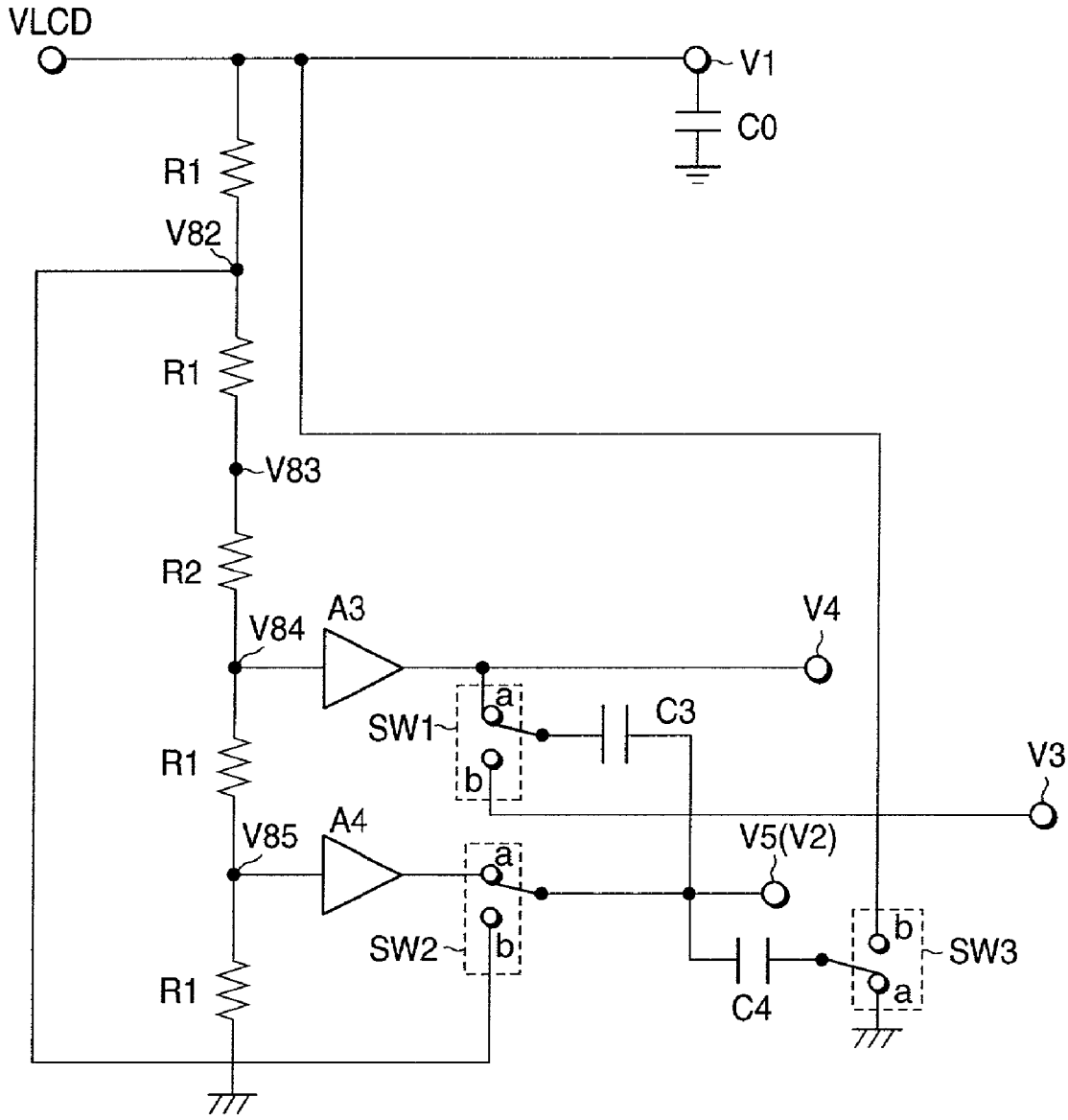
FIG. 8 is a circuit diagram showing a configuration of an LCD drive power supply circuit according to a third embodiment of the present invention.

Next, an LCD drive power supply circuit according to a third embodiment of the present invention is described with reference to FIG. 8. FIG. 8 is a circuit diagram showing a configuration of the LCD drive power supply circuit according to the third embodiment of the present invention. This embodiment is characterized in that the capacitors C3 and C4 are connected in series and that the junction between the capacitors C3 and C4 is rendered to have the potential level V5 or V2 to receive an output of the amplifier or a voltage generated by the resistance division.

The LCD drive power supply circuit according to this third embodiment is advantageous over the first and second embodiments in that the number of the switches can be reduced by one and that the number of selectors in an output driver can also be reduced. The latter advantage is obtained because the junction between the capacitors C3 and C4 has an intermediate potential between the potential level V4 and GND and between the potential levels V1 and V3, making it possible to use the potential levels V2 and V5 as a shared terminal.

It is noted that, unlike the first and second embodiments, the LCD drive power supply circuit according to the third embodiment of the present invention cannot generate the potential levels V2 and V3 independently. Therefore, the capacitors C3 and C4 should be large ones that are not suffered from the level fluctuation.

[Embodiment 4]

Figure 9:
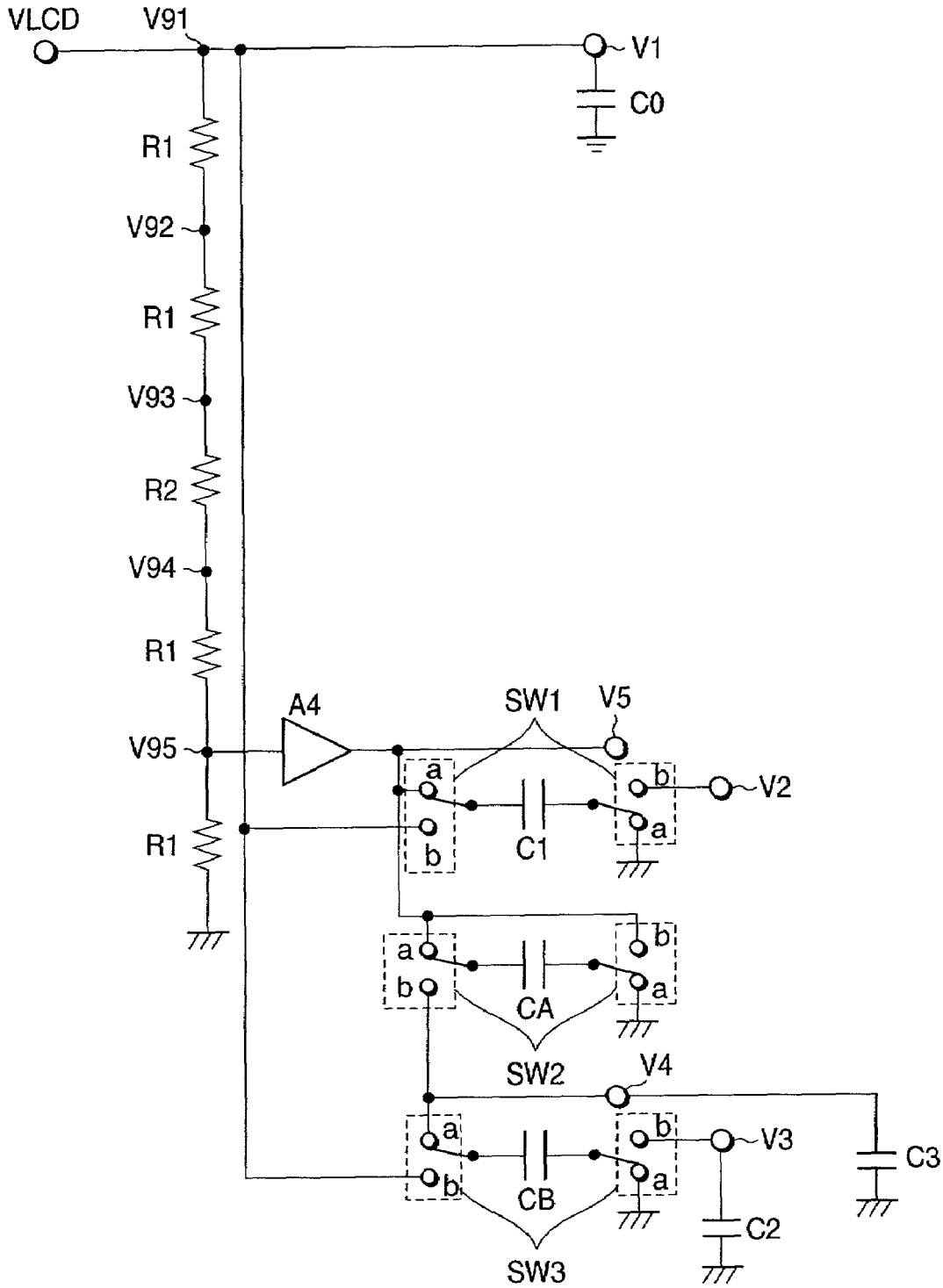
FIG. 9 is a circuit diagram showing a configuration of an LCD drive power supply circuit according to a fourth embodiment of the present invention.
Figure 10:
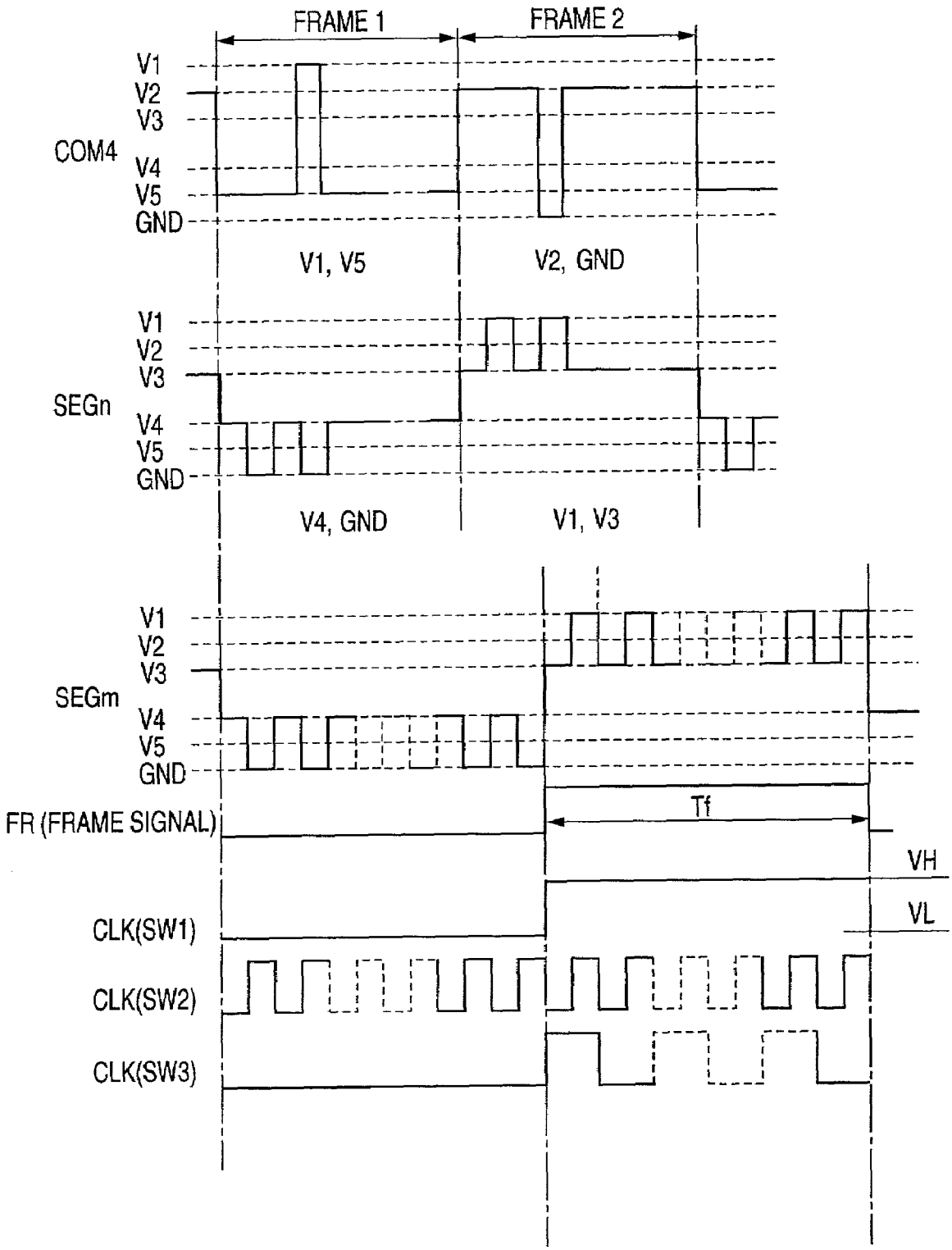
FIG. 10 is a timing chart showing driving waveforms obtained according to the fourth embodiment of the present invention.

Next, an LCD drive power supply circuit according to a fourth embodiment of the present invention is described with reference to FIGS. 9 and 10. FIG. 9 is a circuit diagram showing a configuration of the LCD drive power supply circuit according to the fourth embodiment of the present invention. FIG. 10 is a timing chart showing driving waveforms of COM and SEG.

The LCD drive power supply circuit according to the fourth embodiment is similar to the first embodiment in view of the potential levels V2 and V5. The fourth embodiment is characterized in that generation of the potential level V4 level is generated by using the amplifier A4 that generates the potential level V5 and the capacitor.

More specifically, the present embodiment eliminates one amplifier and adds a capacitor and a switch to provide the LCD drive power supply circuit that generates four different levels with a single amplifier by means of adjusting switch timing of the capacitors.

The fourth embodiment is directed to reduce the area of the semiconductor chip used for the entire circuit and also reduces the circuit current with a single amplifier. The withstanding voltage of the LCD drive power supply circuit according to the fourth embodiment is one fourth of the withstanding voltage in the first through third embodiments. This means that a general process maybe used for the fabrication of the LCD drive power supply circuit. The timing control in the fourth embodiment may be performed based on the driving waveforms of COM and SEG shown in FIG. 10, without affecting the display.

[Embodiment 5]

Figure 11:
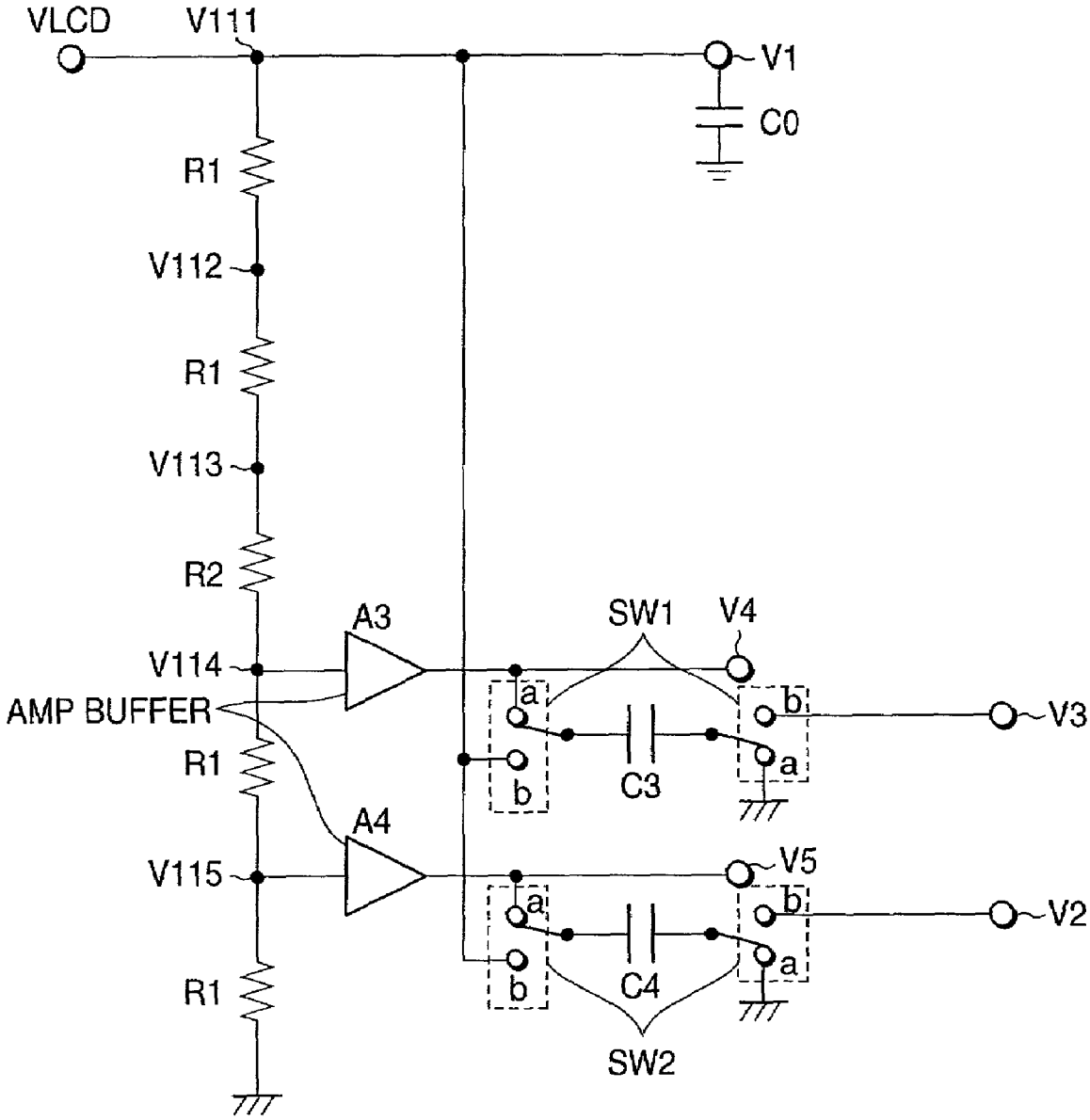
FIG. 11 is a circuit diagram showing a configuration of an LCD drive power supply circuit according to a fifth embodiment of the present invention.
Figure 12:
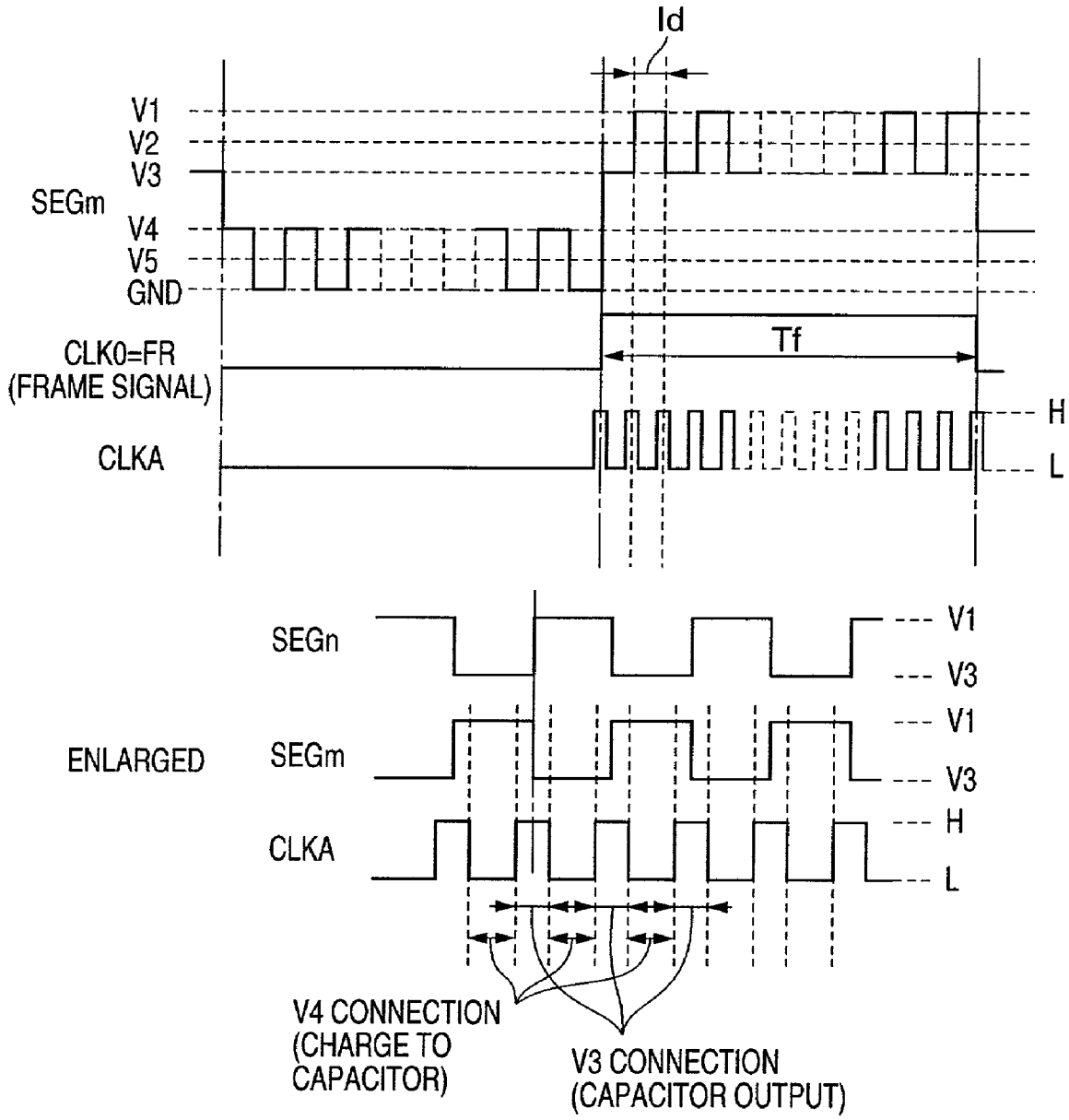
FIG. 12 is a timing chart showing driving waveforms obtained according to the fifth embodiment of the present invention.

Next, an LCD drive power supply circuit according to a fifth embodiment of the present invention is described with reference to FIGS. 11 and 12. FIG. 11 is a circuit diagram showing a configuration of the LCD drive power supply circuit according to the fifth embodiment of the present invention. FIG. 12 is a timing chart showing driving waveforms of COM and SEG. This embodiment is similar to the first embodiment except that the capacitor C31 is eliminated.

In this event, the control timing of the fifth embodiment is based on the manner illustrated in FIG. 12. This makes it possible to generate levels without affecting the display which otherwise occurs due to level reduction. In general, charge and discharge of the panel load are performed at the time of switching of the outputs. With the level stabilized, that level can be maintained by using the load capacity of the panel itself.

Therefore, the bypass capacitor C3 is connected to the potential level V3 level at the timing when the outputs are switched. The capacitor C3 is disconnected when the level is stabilized and is then charged again with the potential level V4 level to be ready for the output of the display data (change in output) in a subsequent line. Since the panel itself is capacitive, the level can be maintained after the level is stabilized even with the capacitor disconnected. Thereafter, level driving is possible without affecting the display. The number of the capacitors as well as the number of the amplifiers can be halved in this embodiment.

[Embodiment 6]

Figure 13:
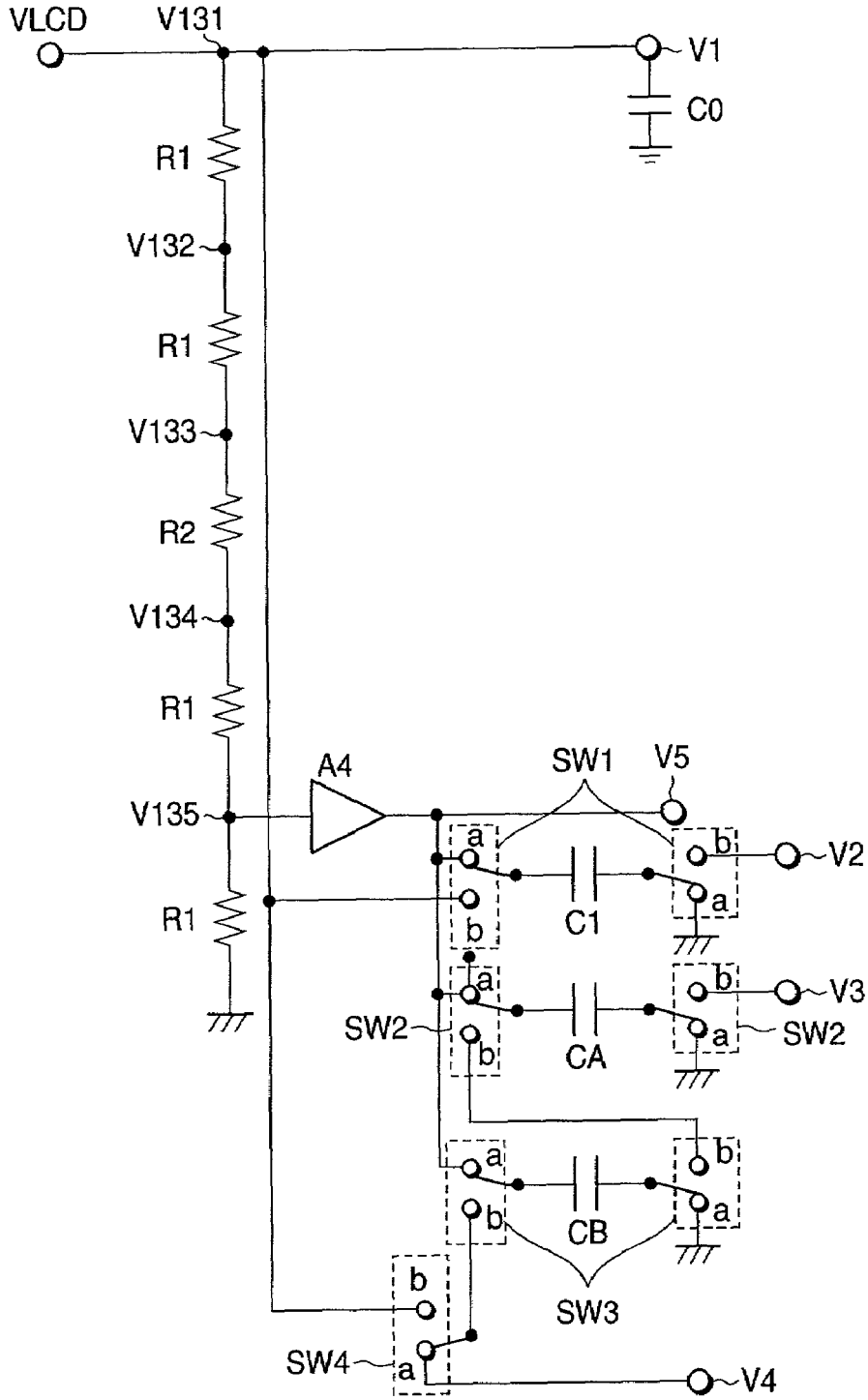
FIG. 13 is a circuit diagram showing a configuration of an LCD drive power supply circuit according to a sixth embodiment of the present invention.
Figure 14:
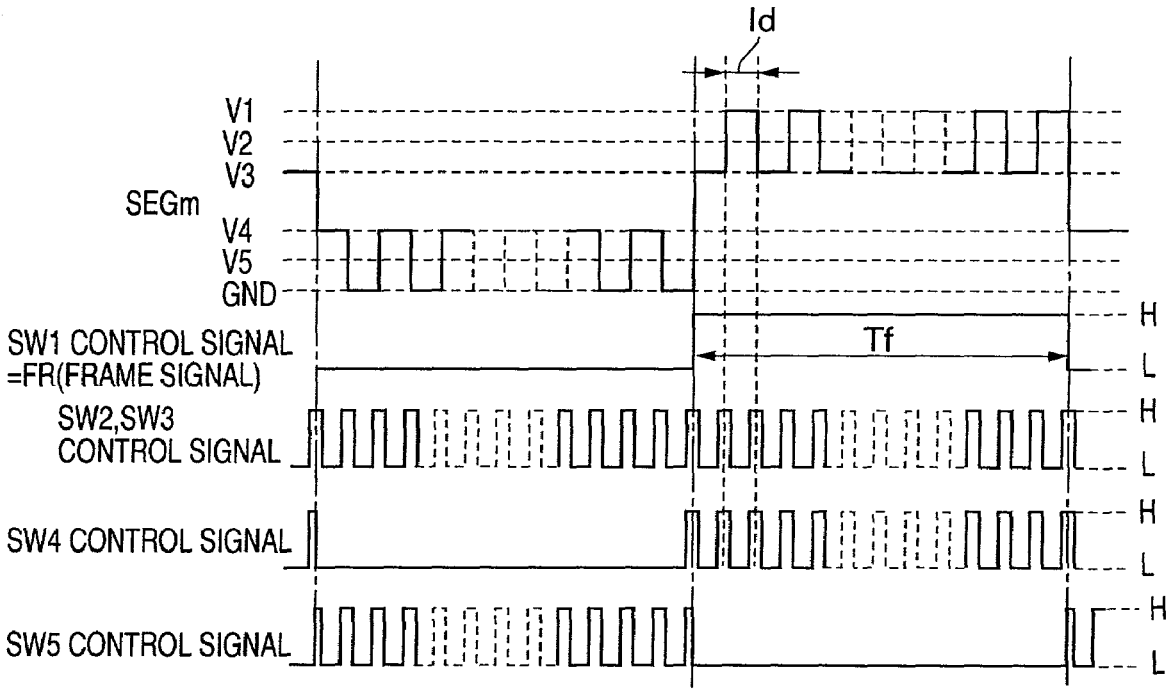
FIG. 14 is a timing chart showing driving waveforms obtained according to the sixth embodiment of the present invention.

Next, an LCD drive power supply circuit according to a sixth embodiment of the present invention is described with reference to FIGS. 13 and 14. FIG. 13 is a circuit diagram showing a configuration of the LCD drive power supply circuit according to the sixth embodiment of the present invention. FIG. 14 is a timing chart showing driving waveforms of COM and SEG. The sixth embodiment is characterized in that the timing shown in FIG. 14 is generated by using a single amplifier with a low level output (potential level V5) and three capacitors to provide the LCD driving levels.

The potential level V2 of the LCD drive power supply circuit according to the sixth embodiment is similar to the generation of the potential level V2 in the fourth embodiment. In this sixth embodiment, two capacitors are connected in series and charged with the potential level V5 and the potential levels V4 and V3 are generated at the timing when the outputs are switched.

Selection of the potential levels V4 and V3 in the sixth embodiment may be generated by means of making one terminal have the potential level V1 or GND for each frame. An advantage of this embodiment lies in the low power consumption and the small number of the components (one amplifier and three capacitors). Similar to the fourth embodiment, the withstanding voltage of the LCD drive power supply circuit according to the sixth embodiment is one fourth of the withstanding voltage achieved in the first through third embodiments.

Numerous changes and modifications of the embodiments herein will be apparent to those skilled in the art in view of the foregoing description. Accordingly, the description is to be construed as illustrative only. The details of the configurations and/or functions may be varied substantially without departing from the scope and spirit of the present invention.

As is apparent from the above, according to the LCD drive power supply circuit of the present invention, upper levels (V2, V3) are generated through capacitors (C3, C4) connected to lower levels (V4, V5), rather than being directly generated through amplifiers, in contrast to the conventional power supply circuit where the levels (V2 to V5) for LCD driving are all generated through the amplifiers.

As a result, it is possible to reduce the number of the amplifiers from four to two. In addition, the capacitor (C4) for the potential level V5 can also be used as the capacitor required for the potential level V2 level, reducing the number of the capacitors. In addition, the capacitor (C3) for the potential level V4 level can also be used as the capacitor for the potential level V3 level by means of selecting the timing of the capacitor switching The LCD drive power supply circuit of the type described allows reduction in number of the components such as amplifiers for level generation and external capacitors, which in turn reduces current consumption of the entire system, chip areas, and mounting areas.

As is apparent from the above, according to the present invention, the capacitors (bypass capacitors) used to stabilize the levels are switched using switche elements. Thus, the required number of the amplifiers becomes less than half that included in the conventional amplifiers, thereby enabling the LCD drive power supply circuit to reduce the number of the output levels. The number of components such as capacitors is reduced by 20% to 50%. As a result, the resultant circuit has a smaller bias current that flows through the amplifiers. This makes it possible to reduce the area occupied by a semiconductor chip on the circuit.

Figure 1A:
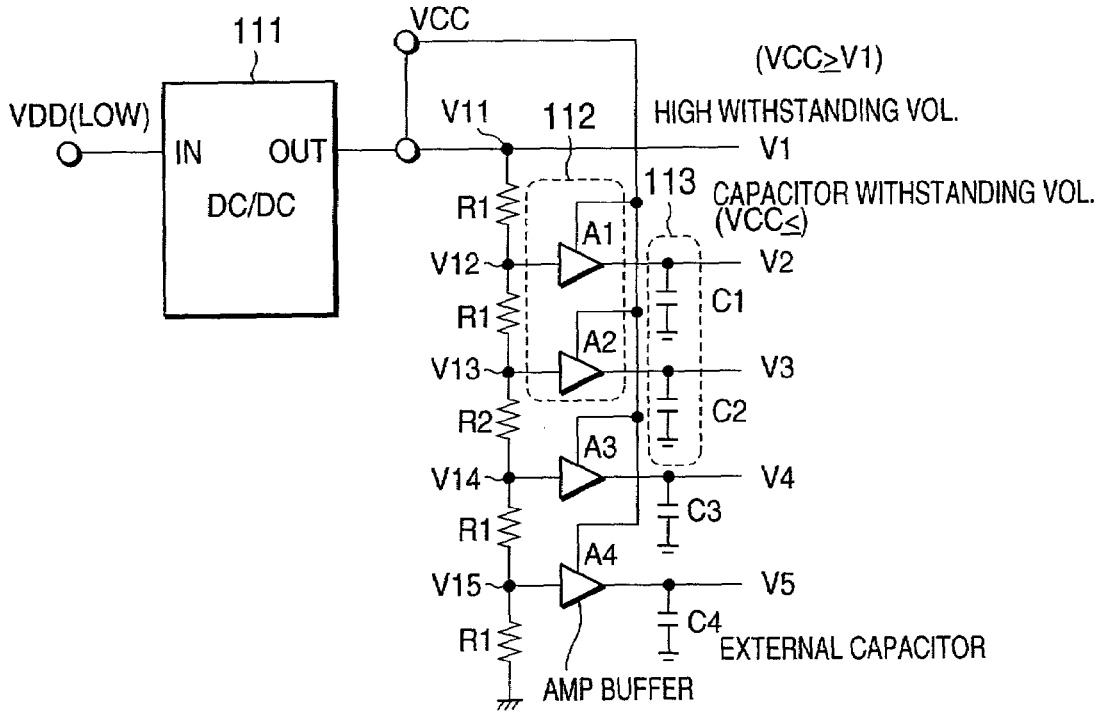
Fig.1A PRIOR ART
FIGS. 1A and 1B are view for use in comparing LCD drive systems achieved with a first prior art and a circuit according to the present invention.
Figure 1B:
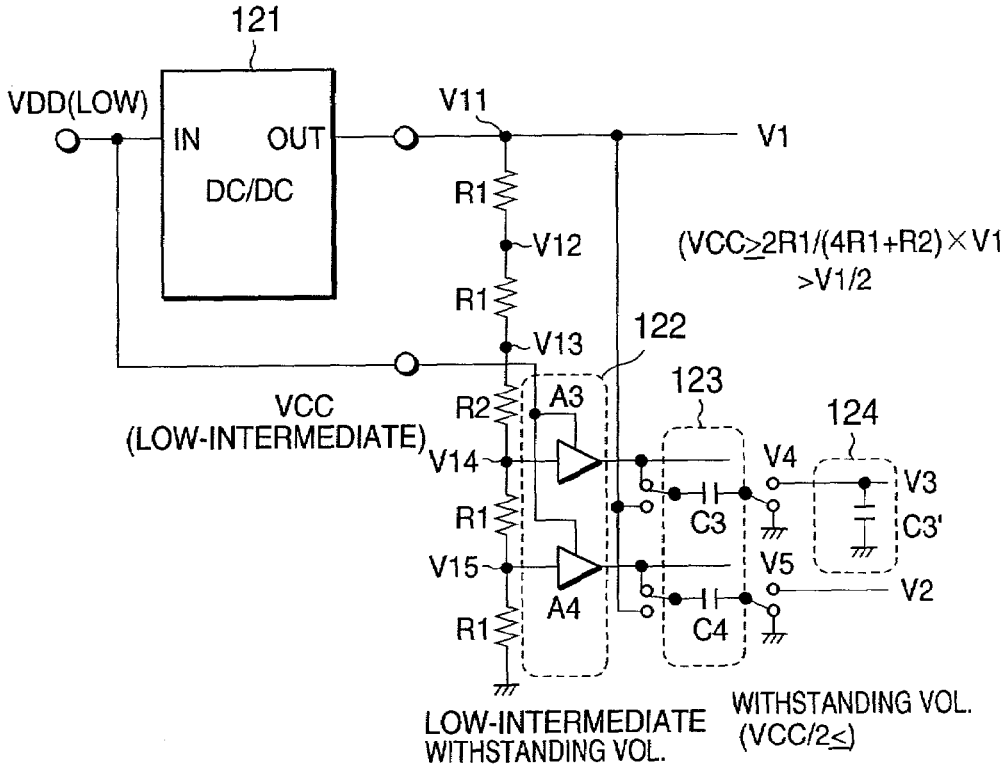

FIG. 1A is a circuit diagram showing a configuration of the LCD driving system that employs the LCD drive power supply circuit constructed in accordance with a prior art. FIG. 1B is a circuit diagram showing a configuration of the LCD driving system that employs the LCD drive power supply circuit constructed in accordance with a first embodiment of the present invention.

The power supply voltages driving the LCD panel are set at higher values than that of the power-supply voltages driving the microcomputer systems. The LCD panel is driven within the range of the power-supply voltage of 5V to 10V(i.e., the peak potential VLCD), which requires that boosting transformer circuit (111,121) must be used in the LCD driving system.

Consequently, it becomes necessary to use components such as capacitors(bypass capacitors) operating within the range of the power-supply voltages of about 10V to 20V.

On the other hand, the LCD drive power supply circuit constructed in accordance with a first embodiment of the present invention operates within the range of the power-supply voltage of V4−GND or V5−GND. The inter-terminal voltage of the capacitor has a level obtained by the following equations:

$$(V4-GND)<(2\times R1/(4\times R1+R2)\times VLCD)<(1/2)$$
$$VLCD=5V$$

Consequently, it is required to use components such as capacitors (bypass capacitors) operating within the range of the power-supply voltage of 5V.

The construction that the LCD driving system employs the LCD drive power supply circuit of the present invention makes it possible to lower the power-supply voltage thereof than that, thereby allowing the system to eliminate a component such as a boosting transformer circuit 121 in FIG. 1B.

In addition, the capacitors and amplifiers require voltages used therein to become lower level. Consequently, the following advantages are obtained. That is, the LCD driving system can be fabricated by using process, components that require a lower withstanding voltage. The resulting chip can be reduced in size, thereby reducing the consumption current of the circuit.

What is claimed is:

1. A power supply circuit that generates a plurality of drive voltages having intermediate voltage levels with respect to a peak voltage level, the intermediate voltage levels being grouped into a first group of voltage levels comprising intermediate voltage levels that are low level with respect to the peak voltage level and a second group of voltage levels comprising intermediate voltage levels that are high level with respect to the peak voltage level, said power supply circuit comprising:

an amplifier having a voltage follower configuration;

at least one capacitor connected to the amplifier, said at least one capacitor and said amplifier generating a first voltage level included in the first group of voltage levels; and a switch circuit controlled at a predetermined timing to switch said at least one capacitor to generate a second voltage level included in the second group of voltage levels with a discharge voltage of said at least one capacitor and the peak voltage level.

2. A power supply circuit for driving liquid crystal display as claimed in claim 1, wherein all voltage levels are generated with n number or less amplifiers and n number or less capacitors when the number of the voltage levels is equal to 2n for the intermediate voltage levels, wherein n is an integer.

3. A power supply circuit for driving liquid crystal display as claimed in claim 1, wherein all voltage levels are generated with n number or less amplifiers and 3n number or less capacitors when the number of the voltage levels is equal to 4n for the intermediate voltage levels, wherein n is an integer.

4. A power supply circuit that generates four intermediate voltage levels with respect to a peak voltage level, said power supply circuit comprising two amplifiers each having a voltage follower configuration, two series-connected capacitors, and a switching means, wherein a first group of voltage levels comprises two intermediate voltage levels that are low level with respect to the peak voltage level and a second group of voltage levels comprises the remaining two intermediate voltage levels, wherein:

said amplifiers and said series-connected capacitors generate the two voltage levels of the first group of voltage levels, and said switching means, controlled at a predetermined timing, switch said series-connected capacitors to generate the two voltage levels of the second group of voltage levels using a discharge voltage from each of said capacitors and the peak voltage level.

5. A power supply circuit as claimed in claim 4, wherein said two capacitors are connected with each other via a junction, wherein one intermediate voltage level of the first group of voltage levels and one intermediate voltage level of the second group of voltage levels are successively generated at the junction.

6. A power supply circuit that generates four intermediate voltage levels with respect to a peak voltage level, said power supply circuit comprising one amplifier having a voltage follower configuration, at least three capacitors, and a switching means, wherein a first group of voltage levels comprises two intermediate voltage levels that are low level with respect to the peak voltage level and a second group of voltage levels comprises the remaining two intermediate voltage levels, wherein:

said amplifier and one of said capacitors generate a first voltage level included in the first group of voltage levels, and said switching means, controlled at a predetermined timing, switches said one of said capacitors to generate a voltage level included in the second group of voltage levels using a discharge voltage of said capacitor and the peak voltage level, and said switching means, controlled at a predetermined timing, series-connects the remaining capacitors to generate the other voltage level included in the second group of voltage levels using discharge voltages of each of said remaining capacitors and the peak voltage level.

7. A power supply circuit as claimed in claim 1, further comprising a segment electrode and a capacitor that stabilizes the voltage levels comprising the second group of voltage levels to be supplied to the segment electrode.

8. A power supply circuit for driving liquid crystal display as claimed in claim 1, wherein said at least one capacitor stabilizes the voltage levels for the second group of voltage levels.

9. A power supply circuit as claimed in claim 1, wherein the timing is in synchronism with a display signal for a liquid crystal display and selection of said at least one capacitor by said switch circuit is timed so as to not affect the liquid crystal display.

10. A power supply circuit as claimed in claim 9, wherein the display signal comprises either one of a frame signal, a data output signal, and a signal generated on the basis of the data output signal.

11. A power supply circuit as claimed in claim 10, further comprising a common electrode and a segment electrode, wherein the connection of said at least one capacitor to the common electrode is controlled by a signal which is in synchronism with the frame signal and wherein the connection of said at least one capacitor to the segment electrode is controlled by a signal which is in synchronism with the data output signal.

12. A power supply circuit for driving liquid crystal display as claimed in claim 1, wherein said predetermined timing connects said at least one capacitor to generate a voltage level only during a certain switching period and the predetermined timing connects said at least one capacitor to a predetermined level to charge said capacitor outside of said switching period.

13. A power supply circuit as claimed in claim 1, wherein said amplifier and said capacitors have a low withstanding voltage.

14. A power supply circuit that generates four intermediate voltage levels with respect to a peak voltage level, said power supply circuit comprising one amplifier having a voltage follower configuration, three capacitors, and a switching means, wherein a first group of voltage levels comprises two intermediate voltage levels that are low level with respect to the peak voltage level and a second group of voltage levels comprises the remaining two intermediate voltage levels, wherein:

said amplifier and two of said capacitors generate the two voltage levels included in the first group of voltage levels, wherein an output voltage of said amplifier and a discharge voltage of one of said capacitors is used to generate a first output voltage level that is greater than the output voltage of said amplifier and said first output voltage charges an external capacitance; and said switching means, controlled at a predetermined timing, switches one of said capacitors to generate a voltage level included in the second group of voltage levels using a discharge voltage of said capacitor and the peak voltage level, and said switching means, controlled at a predetermined timing, switches said external capacitance to charge another one of said capacitors for generating the other voltage level included in the second group of voltage levels.

15. A power supply circuit as claimed in claim 14, wherein said amplifier and said capacitors have a low withstanding voltage.

16. A power supply circuit for driving a display, comprising:

a first power source terminal;

a second power source terminal;

a plurality of resistors connected in series between said first and second power source terminals;

a first amplifier having its input coupled to a connecting point of adjacent resistors among said resistors and its output coupled to a first intermediate voltage output terminal outputting a first intermediate voltage level;

a first capacitor having a first electrode and a second electrode;

a first switch electrically connecting said first electrode with said output of said first amplifier in a first mode connecting said first electrode with and said first power source terminal in a second mode; and a second switch electrically connecting said second electrode with said second power source terminal in said first mode and connecting said second electrode with a second intermediate voltage output terminal outputting a second intermediate voltage level in said second mode.

* * * * *